US005502963A

United States Patent [19]

Inaba

[11] Patent Number: 5,502,963

[45] Date of Patent: Apr. 2, 1996

[54] POWER DEVICE FOR DRIVING AUXILIARY EQUIPMENT FOR INTERNAL COMBUSTION ENGINE

[75] Inventor: Yutaka Inaba, Numazu, Japan

[73] Assignee: Kokusan Denki Co., Ltd., Shizuoka, Japan

[21] Appl. No.: 306,887

[22] Filed: Sep. 15, 1994

[51] Int. Cl.[6] ..... F02M 37/04; F02B 33/04

[52] U.S. Cl. ..... 60/314; 60/324; 123/65 PE; 123/497

[58] Field of Search ..... 60/312, 314, 324; 123/497, 65 PE

[56] References Cited

U.S. PATENT DOCUMENTS

| | | | |
|---|---|---|---|
| 3,482,558 | 12/1969 | Casey | 123/497 |
| 3,502,895 | 3/1970 | Ballou . | |
| 4,827,880 | 5/1989 | Ban | 60/314 |
| 4,920,932 | 5/1990 | Schlunke | 60/312 |
| 5,161,496 | 11/1992 | Matsushima et al. . | |
| 5,373,827 | 12/1994 | Kondon | 123/497 |

FOREIGN PATENT DOCUMENTS

| | | | |
|---|---|---|---|
| 61-4819 | 1/1986 | Japan . | |
| 63-100222 | 5/1988 | Japan . | |
| 63-170541 | 7/1988 | Japan . | |
| 63-259127 | 10/1988 | Japan . | |
| 3275930 | 12/1991 | Japan | 123/65 PE |
| 4-63929 | 2/1992 | Japan . | |

*Primary Examiner*—Douglas Hart
*Attorney, Agent, or Firm*—Pearne, Gordon, McCoy & Granger

[57] ABSTRACT

A power device for driving an auxiliary equipment for an internal combustion engine capable of driving both a fuel injection unit and a valve without specifically providing a adjusting valve when the engine includes no battery acting as a power supply. A generator driven by the internal combustion engine is provided therein with a generating coil for driving the auxiliary equipment which is common to both a pump motor and an actuator. A driving power feed circuit is arranged for feeding driving power to the pump motor and actuator from the generating coil for driving the auxiliary equipment which acts as a power supply. The driving power feed circuit includes a pump driving switch for switching a driving current of the pump motor, an actuator driving switch for switching a driving current of the actuator, and a switch control unit for turning on the pump driving switch and actuator driving switch at duty ratios different from each other, respectively.

9 Claims, 6 Drawing Sheets

POWER DEVICE FOR DRIVING AUXILIARY EQUIPMENT FOR INTERNAL COMBUSTION ENGINE

BACKGROUND OF THE INVENTION

This invention relates to a power device for driving an auxiliary equipment for an internal combustion engine, and more particularly to a power device for driving an auxiliary equipment which is arranged on the internal combustion engine and feeds driving power from a generator driven by the internal combustion engine to a motor for driving a fuel pump for feeding fuel to an injector and an actuator for driving an exhaust characteristic adjusting valve for adjusting characteristics of an exhaust system.

Recently, an auxiliary equipment of the electric type has been generally used for the purpose of improving performance of an internal combustion engine. Such an auxiliary equipment is adapted to be attached to an internal combustion engine to operate the engine. Typically, an internal combustion engine tends to incorporate a fuel injection device acting as a fuel feed means therein. Such a fuel injection device generally requires an injector of the electric type, a fuel pump for feeding fuel to the injector and a pump motor (electric motor) for driving the fuel pump. For example, Japanese Patent Application Laid-Open Publication No. 170541/1988, Japanese Patent Application Laid-Open Publication No. 259127/1988 and U.S. Pat. No. 5,161,496 each disclose a fuel injection device which includes a fuel feed means comprising an injector and a fuel pump for feeding the injector with fuel.

Also, an improvement in performance of an internal combustion engine at a high rotation speed of the engine has been carried out by arranging an exhaust valve for adjusting characteristics (resonance frequency) of an exhaust system of the engine. The exhaust valve is adjusted during driving of the engine at a high rotation speed to cause a standing wave to be generated in the exhaust system, resulting in exhaust and air intake taking place with increased efficiency. However, this requires to arrange an actuator of the electric type for actuating the exhaust valve. For example, Japanese Patent Application Laid-Open Publication No. 4819/1986 and Japanese Patent Application Laid-Open Publication No. 100222/1988 each disclose use of an exhaust characteristic adjusting valve.

Also, a gasoline engine requires an ignition device, as well as an electronic device such as a microcomputer, CPU or the like for controlling an ignition timing of the engine and an injection timing of fuel of the engine.

Conventionally, the fuel injection device has been exclusively used for an internal combustion engine for a vehicle mounted with a battery, therefore, it is generally constructed so as to be operated while using the battery as a power supply therefor. In addition, it is now desired that the fuel injection device is used for an internal combustion engine for a vehicle mounted with no battery such as an outboard boat, a snow mobile or the like. However, this requires to drive an injector or an actuator using a magneto driven by the engine as a power supply.

Also, even when the vehicle is mounted with a battery, it is often required to drive the fuel injection device by means of an output of the magneto and start the engine through a man-powered starting device. For example, a vehicle used in a cold district such as a snow mobile or the like requires man-powered starting operation because the battery is unserviceable in a cold season, thus, use of the fuel injection device causes a magneto to be required for driving it. Also, when such a failure in operation of an internal combustion engine as encountered with a snow mobile or an outboard boat causes an operator to meet with any danger, a starting device is preferably used in combination with a battery. Further, even when the fuel injection device is driven by means of a battery, it is desirably driven by a magneto when the batter is unserviceable.

In order to permit the fuel injection device to be serviceable without using any battery in view of the foregoing, the prior art proposes a construction wherein a generating coil for driving a pump is provided in a magneto mounted on an internal combustion engine to drive a pump motor, as disclosed in U.S. Pat. No. 3,502,895 and Japanese Patent Application Laid-Open Publication No. 63929/1992.

Further, U.S. Pat. No. 5,161,496 and Japanese Patent Application Laid-Open Publication No. 259127/1988 each propose application of a fuel injection device to an internal combustion engine for a vehicle mounted with no battery. The application is accomplished by using a fuel pump of the mechanical type requiring no electricity and incorporating a generating coil for lighting rather than a generating coil for ignition in a generator for the purpose of controlling the fuel injection device.

Moreover, in view of the fact that only a half-cycle output of an ignition power coil provided in a magneto is used for feeding of ignition energy, it is attempted that the remaining half-cycle output of the ignition power coil which is not utilized for feeding of ignition energy is used for a DC power supply, of which an output is used for driving an injector or an electronic device such as a microcomputer or the like.

In addition, it is considered that in order to provide an exhaust characteristic adjusting valve on an engine for a vehicle mounted with no battery, a generating coil for driving the valve is arranged in a magneto mounted on the engine, to thereby permit the generating coil to feed an actuator for driving the valve with electric power.

Unfortunately, the magneto is required to produce electric power for lighting as well, so that the magneto is conventionally provided therein with an ignition power coil and a generating coil for driving a pump. Thus, it is substantially impossible to further provide the above-described valve-driving generating coil in the magneto constructed in a conventional manner. Arrangement of the valve-driving generating coil in the magneto causes it to be large-sized, leading to large-sizing of the engine and to be increased in manufacturing cost.

SUMMARY OF THE INVENTION

The present invention has been made in view of the foregoing disadvantage.

Accordingly, it is an object of the present invention to provide a power device for driving an auxiliary equipment for an internal combustion engine which is capable of driving both a fuel injection device and a valve while eliminating a necessity of a generating coil exclusively used for an exhaust characteristic adjusting valve.

It is another object of the present invention to provide a power device for driving an auxiliary equipment for an internal combustion engine which is capable of feeding an actuator for driving an exhaust characteristic adjusting valve with driving power without sacrificing driving power for a pump motor.

It is a further object of the present invention to provide a power device for driving an auxiliary equipment for an internal combustion engine which is capable of driving both a fuel pump for a fuel injection unit and an exhaust characteristic adjusting valve without using any battery.

In accordance with the present invention, a power device is provided which is adapted to drive, of a plurality of auxiliary equipments arranged on an internal combustion engine, an auxiliary equipment for feeding electric power from a generator driven by the internal combustion engine to a pump motor for driving a fuel pump arranged in a fuel feed system including a pressure regulator and an actuator of the electric type for driving an exhaust characteristic adjusting valve for adjusting characteristics of an exhaust system. The power device includes a generating coil arranged in the generator in a manner to be common to the pump motor and actuator and a driving power feed circuit for feeding driving power to the pump motor and actuator from the generating coil for driving the auxiliary equipment which acts as a power supply.

In a preferred embodiment of the present invention, the driving power feed circuit includes a pump driving switch for switching a driving current of the pump motor, an actuator driving switch for switching a driving current of the actuator and a switch control unit for turning on the pump driving switch and actuator driving switch at duty ratios different from each other, respectively.

In a preferred embodiment of the present invention, the switch control unit keeps only the pump driving switch turned on until a rotation speed of the internal combustion engine reaches a set value and renders the pump driving switch and actuator driving switch respectively turned on at duty ratios different from each other when the rotation speed exceed the set value.

In a preferred embodiment of the present invention, the switch control unit includes a rotation speed detection signal generator for generating a rotation speed detection signal varied in proportion to a rotation speed of the internal combustion engine, a voltage limit circuit for limiting a value of the rotation speed detection signal to a predetermined limit value or less, which limit value is set to be larger than the set value, a triangular-wave signal generator for generating a triangular-wave signal to which a DC bias voltage equal to the set value is added, and a comparator for carrying out comparison between the rotation speed detection signal output from the voltage limit circuit and the triangular-wave signal output from the triangular-wave signal generator. The comparator generates a signal for turning on the actuator driving switch during a period of time for which the rotation speed detection signal is kept larger than the triangular-wave signal and generating a signal for turning on the pump driving switch during the remaining period of time.

In a preferred embodiment of the present invention, the switch control unit generates a signal for turning on the pump driving switch and actuator driving switch at the duty ratios by means of a microcomputer.

Also, in accordance with the present invention, a power device for driving an auxiliary equipment for an internal combustion engine is provided which is provided on an internal combustion engine of the fuel injection type and feeds electric power from a magneto driven by the internal combustion engine to a pump motor for driving a fuel pump for feeding fuel to an injector and an actuator of the electric type for driving an exhaust characteristic adjusting valve. The power device includes a generating coil arranged in the magneto for driving the auxiliary equipment and a driving power feed circuit for feeding driving power to the pump motor and actuator from the generating coil for driving the auxiliary equipment which acts as a power supply. The driving power feed circuit includes a pump driving switch for switching a driving current of the pump motor, an actuator driving switch for switching a driving current of the actuator, and a switch control unit for turning on the pump driving switch and actuator driving switch at duty ratios different from each other, respectively.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a power device for driving an auxiliary equipment for an internal combustion engine according to the present invention will be described hereinafter with reference to the accompanying drawings.

Figure 1:
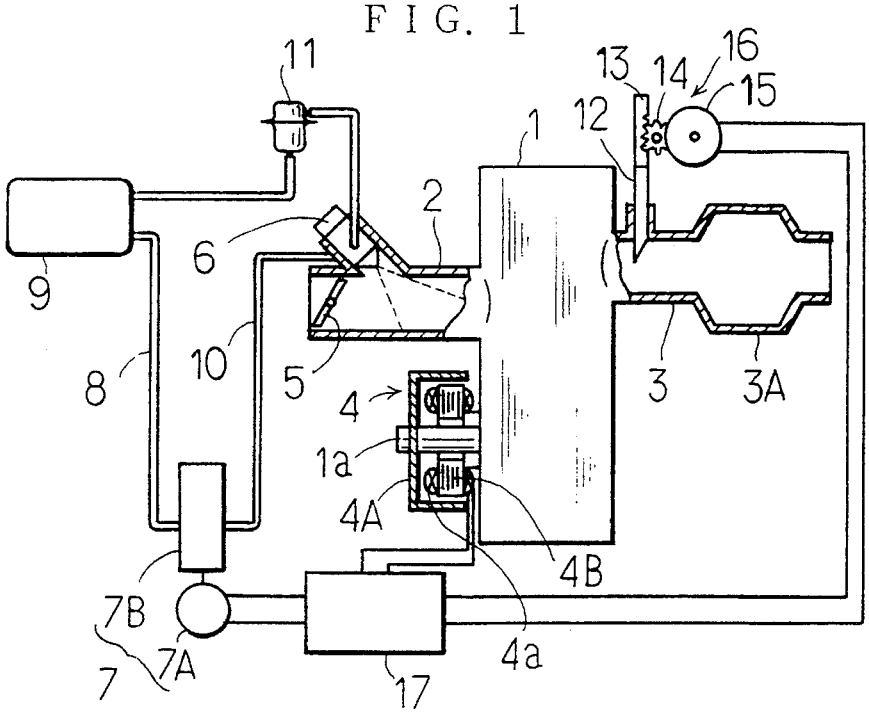
FIG. 1 is a schematic view showing an embodiment of a power device for driving an auxiliary equipment for an internal combustion engine according to the present invention.

Referring first to FIG. 1, an embodiment of a power device for driving an auxiliary equipment for an internal combustion engine according to the present invention is illustrated. In FIG. 1, reference numeral 1 designates an internal combustion engine including an air intake pipe 2 and an exhaust pipe 3, 4 is a magneto including a magnet rotor 4A mounted on an output shaft 1*a* of the internal combustion engine 1 and a stator 4B mounted on a casing of the engine 1.

The air intake pipe 2 is mounted on a side of an inlet thereof with a throttle valve 5, as well as an injector 6 for injecting fuel into an inner space of the pipe 2 defined on a downstream side of the throttle valve 5. The injector 6 includes a valve for operating an injection port and an electromagnet for operating the valve, wherein the electromagnet is excited during a period of time for which an injection command signal is fed, to thereby open the valve.

Reference numeral 7 designates a fuel pump including a pump motor (electric motor) 7A and a pump 7B driven by the motor 7A. The pump 7B is connected at a suction port thereof through a pipe 8 to a fuel tank 9 and at a discharge port thereof through a pipe 10 to a fuel feed port of the injector 6.

Reference numeral 11 designates a pressure regulator connected between the fuel feed port of the injector 6 and the fuel tank 9. The pressure regulator 11 functions to return a part of fuel to the fuel tank 9 when a pressure of fuel fed to the fuel feed port of the injector 6 exceeds a predetermined level, to thereby keep a fuel pressure or a pressure of fuel fed to the injector constant. A little more specifically, in order that when fuel is fed to the engine by means of the injector 6, a feed rate of fuel is determined depending on a period of time during which the valve of the injector 6 is kept open (or a period of time during which the injector is fed with an injection command), the pressure regulator 11 is arranged on a route through which fuel is fed from the motor-driven pump 7B to the injector 6 to keep a fuel pressure or a pressure of fuel fed to the injector 6 at a constant level.

When the injector 6 is fed with the injection command signal, the valve of the injector 6 is caused to be open, so that fuel may be injected through the injection port of the injector 6 into the air intake pipe 2. The amount of fuel fed to the engine depends on the fuel pressure and an injection period. A period of time for which the injection command signal is fed to the injector is controlled so that a cylinder of the engine is fed with mixed gas of an optimum air-fuel ratio at each of rotation speeds of the engine.

The exhaust pipe 3 is provided with a cavity 3A and an exhaust characteristic adjusting valve 12 is arranged so as to vary a sectional area of an opening of a portion of the pipe positioned on an upstream side of the cavity 3A. In the illustrated embodiment, the exhaust characteristic adjusting valve 12 comprises a linearly displaceable valve which is constructed so as to be accessible to the exhaust pipe 3 in a direction perpendicular to an axial direction of the exhaust pipe 3 to vary the sectional area of the opening of the exhaust pipe 3. The valve 12 is actuated by an actuator 16 comprising a rack 13 connected to the valve 12, a pinion 14 meshed with the rack 13 and an electric motor 15 for rotatably driving the pinion 14. Alternatively, the exhaust characteristic adjusting valve 12 may comprise a rotation-type valve.

The exhaust characteristic adjusting valve 12 is constructed so as to permit resonance to occur in the cavity defined in the exhaust system during high rotation speed operation of the engine to increase exhaust efficiency. The valve 12 is operated by the actuator 16 so that a degree of opening thereof is optimum.

Figure 9:
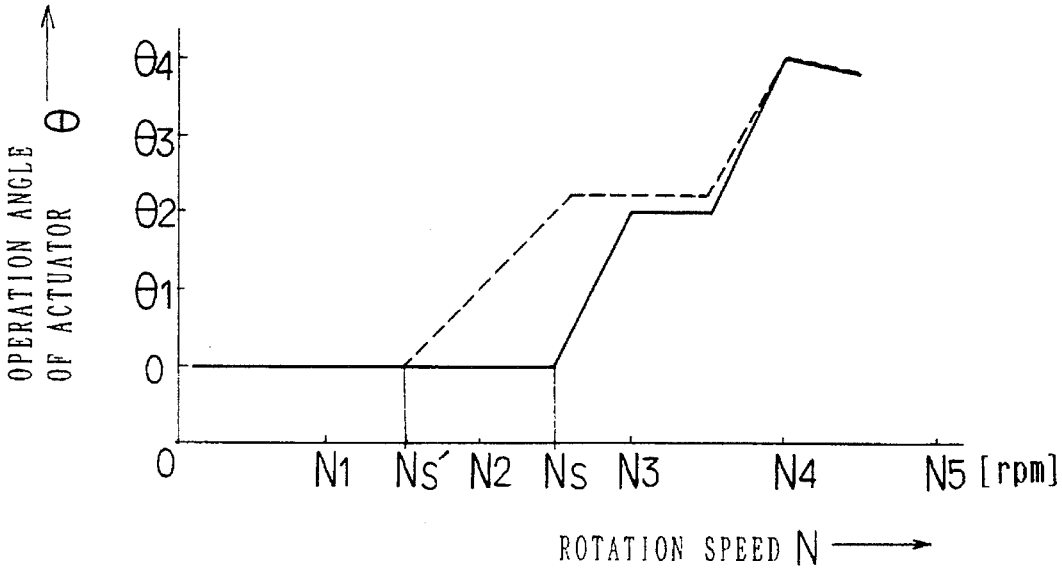
FIG. 9 is a diagrammatic view showing an example of operational characteristics of an exhaust characteristic adjusting valve.

FIG. 9 exemplifies a variation of an operation angle θ of the actuator 16 for operating the exhaust characteristic adjusting valve 12 to a rotation speed N of the engine. In FIG. 9, solid lines indicate an example obtained by feeding the actuator 16 with a driving current in a region of a predetermined rotation speed Ns (>N2) of the engine to vary the operation angle θ from 0 to θ4 ($0<\theta1<\theta2<\theta3<\theta4$). In the example shown in FIG. 9, a degree of opening of the exhaust characteristic adjusting valve is lowermost when the operation angle of the actuator is 0 and gradually increased with an increase in operation angle of the actuator 16. Adjustment of the degree of opening of the exhaust characteristic adjusting valve in a region of the predetermined rotation speed Ns or more permits resonance to occur in the exhaust pipe to increase the amount of gas flowing into the exhaust pipe, to thereby increase air intake efficiency, leading to an improvement in output of the engine.

For the purpose of carrying out control in a manner to permit the degree of opening of the exhaust characteristic adjusting valve to be coincided with a target opening degree, a position sensor is arranged for detecting a position of the exhaust characteristic adjusting valve, so that control of the actuator 16 is carried out so as to coincide the position of the valve detected by the position sensor with a target position.

In the present invention, the magneto 4 is provided therein with the generating coil 4*a* for driving the auxiliary equipment which is common to the pump motor 7A and actuator 16, so that an output of the generating coil 4*a* for driving the auxiliary equipment is fed through a driving power feed circuit 17 to the pump motor 7A and actuator 16.

The magneto 4 is provided therein with an ignition power coil for feeding an ignition device of the engine with ignition energy in addition to the above-described generating coil 4*a*, as well as an additional generating coil for driving a load for lighting or the like as required. The ignition power coil is adapted to induce an AC voltage in synchronism with rotation of the engine. Normally, only a positive half-cycle output of the ignition power coil is used for feeding ignition energy to the ignition device, therefore, a negative half-cycle output thereof is used for constituting a power circuit for generating a DC constant voltage. The power circuit may be constituted by, for example, a power capacitor charged by means of the negative half-cycle output of the ignition power coil and a control circuit for keeping a voltage across the power capacitor at a constant value. The power circuit may be used as a power supply for a control circuit for controlling an ignition timing and a timing of injection of fuel, a microcomputer or the like, as well as a power supply for feeding the injector with an injection command signal.

A rate of discharge of fuel from the fuel pump 7B driven by the motor 7*a* is substantially proportional to driving torque of the motor, which is proportional to a driving current of the motor. For a period of time during which a rotation speed of the engine is kept low and an output of the magneto 4 is kept low, a discharge pressure of the pump 7B fails to reach a value necessary to maintain a rated value of the fuel pressure (adjusted by the pressure regulator), so that a driving current of the motor 7A is increased with an increase in rotation speed of the engine. When a rotation speed of the engine exceeds a predetermined value, a discharge pressure of the pump 7B tries to exceed the rated value of the fuel pressure. However, the fuel pressure is maintained at the rated value by the pressure regulator 11, to thereby cause a discharge pressure of the pump 7B to be maintained at a constant value, so that a driving current of the motor 7A is limited to a constant value. This causes an output of the generating coil 4*a* to be excessive in a middle or high rotation speed region of the engine and the excessive output is then discarded.

The exhaust characteristic adjusting valve 12 arranged in the exhaust system is operated substantially only at a high rotation speed of the engine, therefore, it is merely required to feed the actuator 16 with driving power at a high rotation speed of the engine.

Thus, when the generating coil 4*a* for driving the auxiliary equipment is arranged in a manner to be common to both pump motor 7A and actuator 16 to drive the pump motor 7A and actuator 16 as in the illustrated embodiment, an output of the generating coil 4*a* for driving the auxiliary equipment is exclusively used for driving the pump motor 7A in a low rotation speed region of the engine in which it is not required to drive the exhaust characteristic adjusting valve 12, to thereby ensure that the pump motor 7A may be smoothly operated without any difficulty. Also, in a high rotation speed region of the engine in which the generating coil 4*a* exhibits a sufficient output, this permits the actuator 16 for driving the valve to be fed with driving power without sacrificing driving power of the pump motor 7A.

Thus, the illustrated embodiment is so constructed that the pump motor 7A and valve driving actuator 16 are driven by the generating coil 4*a* common to both. Such construction permits both fuel pump 7B and exhaust characteristic adjusting valve 12 to be satisfactorily driven without any difficulty by means of a down-sized magneto. Also, it permits performance of the engine to be improved by means of the fuel injection unit and exhaust characteristic adjusting valve without using a large-sized magneto, even when any battery is not mounted on the engine.

Figure 2:
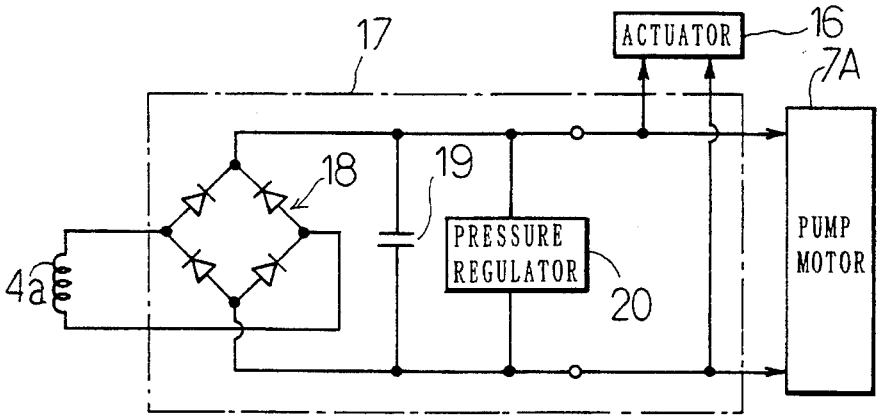
FIG. 2 is a circuit diagram showing a driving power feed circuit which may be incorporated in a power device for driving an auxiliary equipment for an internal combustion engine of the present invention.

FIG. 2 shows an example of the driving power feed circuit 17, which includes a full-wave rectifier 18 for rectifying an output of the generating coil 4*a* for driving the auxiliary equipment, a smoothing power capacitor 19 connected across the rectifier 18 and a voltage regulator 20 functioning to limit a voltage across the capacitor 19 to a level equal to a rated voltage V1 of the pump motor 7A or less, and a DC voltage across the capacitor 19 is fed to the pump motor 7A and actuator 16.

The voltage regulator 20 is constituted by a circuit which short-circuits the generating coil 4*a* when a voltage across the capacitor 19 exceeds the rated value, to thereby lower an output voltage of the generating coil 4*a* and releases short-circuiting of the generating coil 4*a* when the voltage is lowered to the rated value or less, to thereby restore the output voltage. The voltage regulator 20 controls an output voltage of the generating coil 4*a* so as to limit a voltage across the capacitor 19 to the rated value or less.

Figure 8:
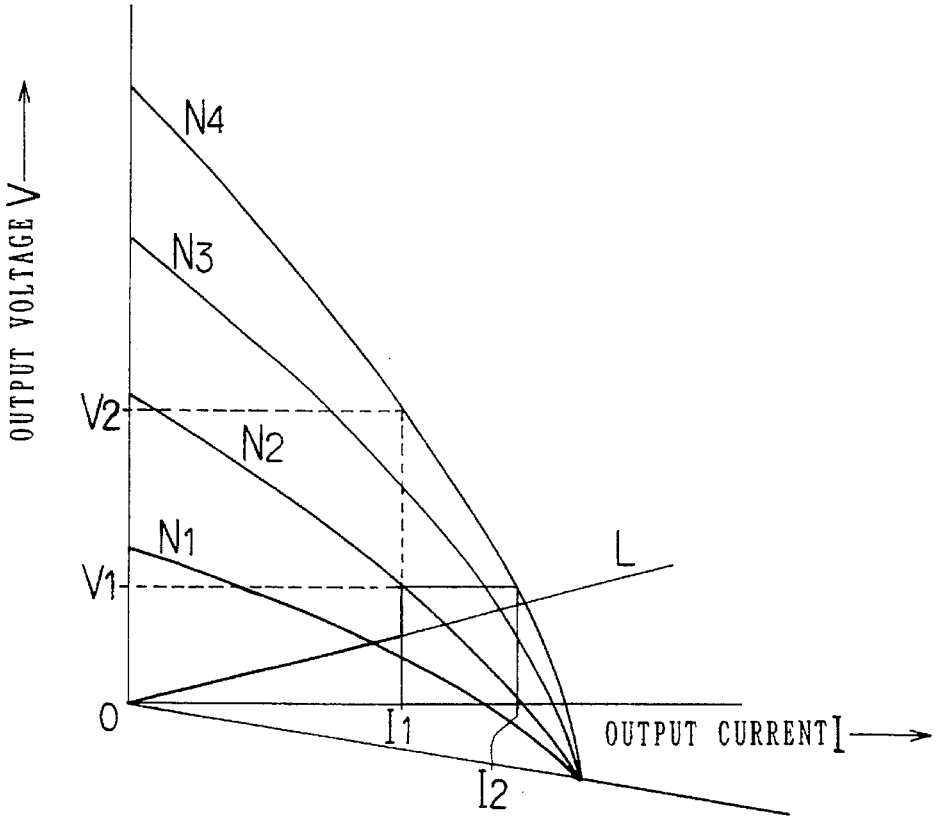
FIG. 8 is a diagrammatic view showing an example of output-voltage to output-current characteristics of a magneto.

Output characteristics of the magneto 4 may be as indicated by, for example, curves N1 to N4 in FIG. 8. The curves N1 to N4 indicate output-voltage V to load-current I characteristics obtained when rotation speeds of the engine are N1 to N4 (N1<N2<N3<N4), respectively. A linear line L in FIG. 8 indicates load characteristics of the pump motor. Also, I1 in FIG. 8 is a rated current of the pump motor 7A determined depending on a value adjusted by the pressure regulator 11. When a driving current of the pump motor 7A reaches the rated current I1, a discharge pressure of the pump 7B is caused to reach an adjusted value of the pressure regulator 11.

Figure 10:
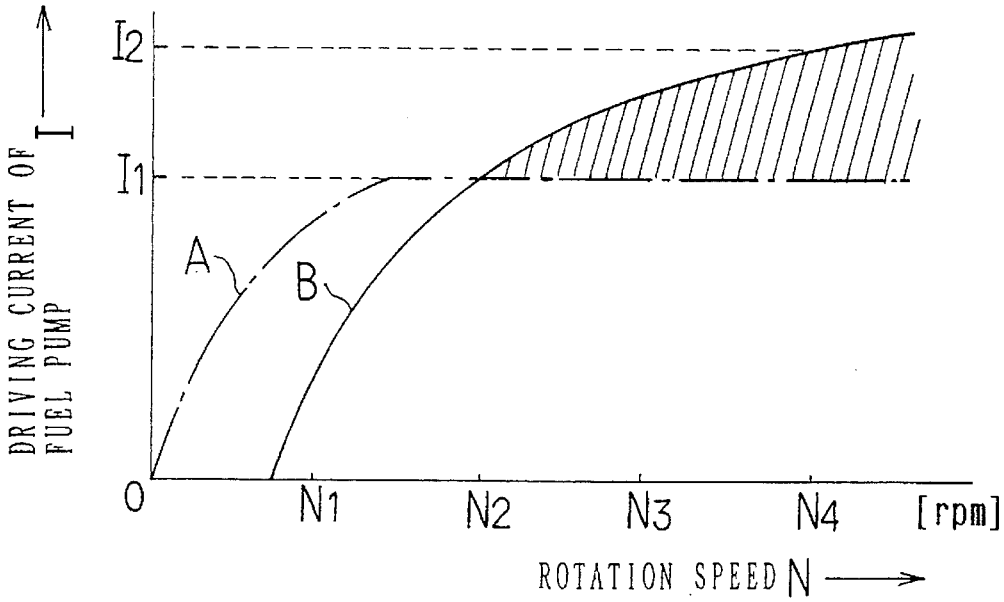
FIG. 10 is a diagrammatic view showing a region in which an actuator can be driven when the driving power feed circuit of FIG. 2 is used, wherein the region is indicated by means of driving-current to engine-speed characteristics of a fuel pump and load-current to engine-speed characteristics obtained when an output voltage of a generating coil for driving an auxiliary equipment generates a rated voltage of a pump motor.

A driving current of the pump motor 7A is increased with an increase in rotation speed N as indicated by a curve A in FIG. 10. A curve B in FIG. 10 indicates load-current to rotation-speed characteristics when the generating coil 4*a* for driving the auxiliary equipment generates a rated voltage V1 for the pump motor.

When the rotation speed exceeds N1, a driving current of the pump motor 7A is permitted to reach the rated current I1. When a driving current of the pump motor 7A exceeds the rated value I1, a discharge pressure of the pump 7B overcomes an adjusted value of pressure by the pressure regulator 11. However, when a discharge pressure of the pump 7B is to exceed an adjusted value of the pressure regulator 11, the pressure is adjusted by the pressure regulator 11 to cause a discharge pressure of the pump 7B to be reduced, so that load torque of the pump motor 7A is rendered constant. Thus, even when a rotation speed of the engine is increased, the driving current is kept at the rated current I1. A voltage applied to the pump motor 7A is increased with an increased in rotation speed, so that when the rotation speed reaches N2, a voltage applied to the pump motor 7A reaches the rated voltage V1. Supposing that the voltage regulator 20 is not arranged, a voltage applied to the pump motor 7A when the rotation speed is increased to N4 is caused to be V2 (FIG. 8).

In the illustrated embodiment, the voltage regulator 20 is arranged for the purpose of adjusting an output voltage of the generating coil 4*a* to restrict a voltage across the power capacitor 19 to a level of the rated value V1 or less, so that an applied voltage of the pump motor 7A is kept at V1. When the rotation speed reaches N4 while the applied voltage is kept limited to V1, a current is permitted to flow from the generating coil 4*a* to a load as shown in FIG. 8. However, the pressure regulator 11 is arranged, therefore, a driving current of the pump motor 7A is restricted to the rated value I1, so that when the pump motor 7A acts as a load with respect to the generating coil 4*a*, power V1×(I2-I1) is uselessly consumed by the voltage regulator 20 when a rotation speed of the engine is increased to N4. When only the pump motor 7A acts as a load with respect to the generating coil 4*a*, it can feed a current in a range indicated at oblique lines in FIG. 10 to another load in a middle to high rotation speed region in which a rotation speed of the engine exceeds N2.

In the present invention, surplus electric power generated in a region in which the rotation speed exceeds N2 is used for driving the actuator 16, so that both pump motor 7A and actuator 16 can be driven by the generating coil 4*a* for driving the auxiliary equipment which is common to both.

Figure 3:
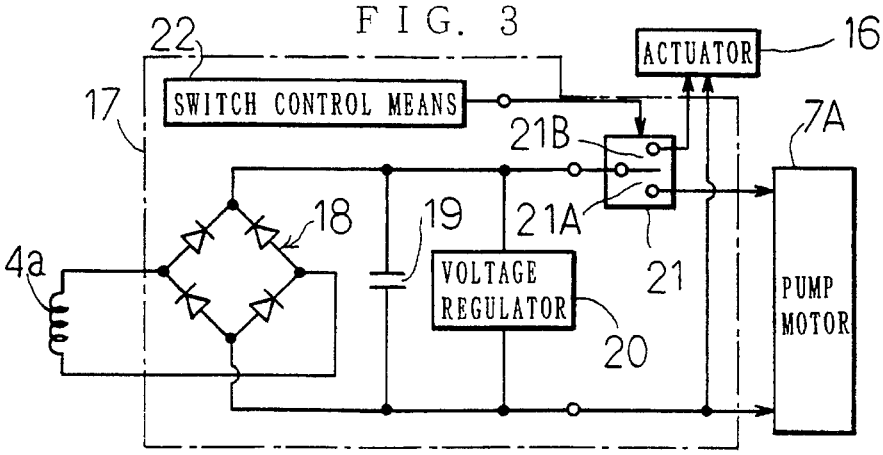
FIG. 3 is a circuit diagram showing a modification of the driving power feed circuit of FIG. 2.

Referring now to FIG. 3, another embodiment of a power device for driving an auxiliary equipment for an internal combustion engine according to the present invention is illustrated. A power device of the illustrated embodiment includes a switch circuit 21 for selectively feeding a pump motor 7A and an actuator 16 with a current flowing from a generating coil 4*a* through a rectifier 18 and a switch control means 22 for controlling the switch circuit 21. The switch circuit 21 includes a pump driving switch 21A for switching a driving current of the pump motor 7A and an actuator driving switch 21B for switching a driving current of the actuator 16. The switching means 22 functions to render the pump driving switch 21A and actuator driving switch 21B alternately conductive at duty ratios Dp and Da different from each other, respectively.

A duty ratio D is defined by the following formula:

$$D = Ton/(Ton+Toff)$$

wherein Ton is an ON-term of a switch and Toff is a off-term thereof. A relationship Dp+Da=1 is established.

The above-described construction of the illustrated embodiment permits an output of the generating coil 4*a* for driving the auxiliary equipment to be appropriately distributed to the pump motor 7A and actuator 16, so that the actuator 16 may be operated without deteriorating operation of the pump motor 7A even at a relatively low rotation speed of the engine. Thus, it is also possible to start operation of the actuator 16 at a rotation speed Ns' of the engine set at a low level compared with at a rotation speed N2 of the engine at which a voltage applied to the pump motor 7A reaches a rated value V1, as indicated at dotted lines in FIG. 9.

Figure 4:
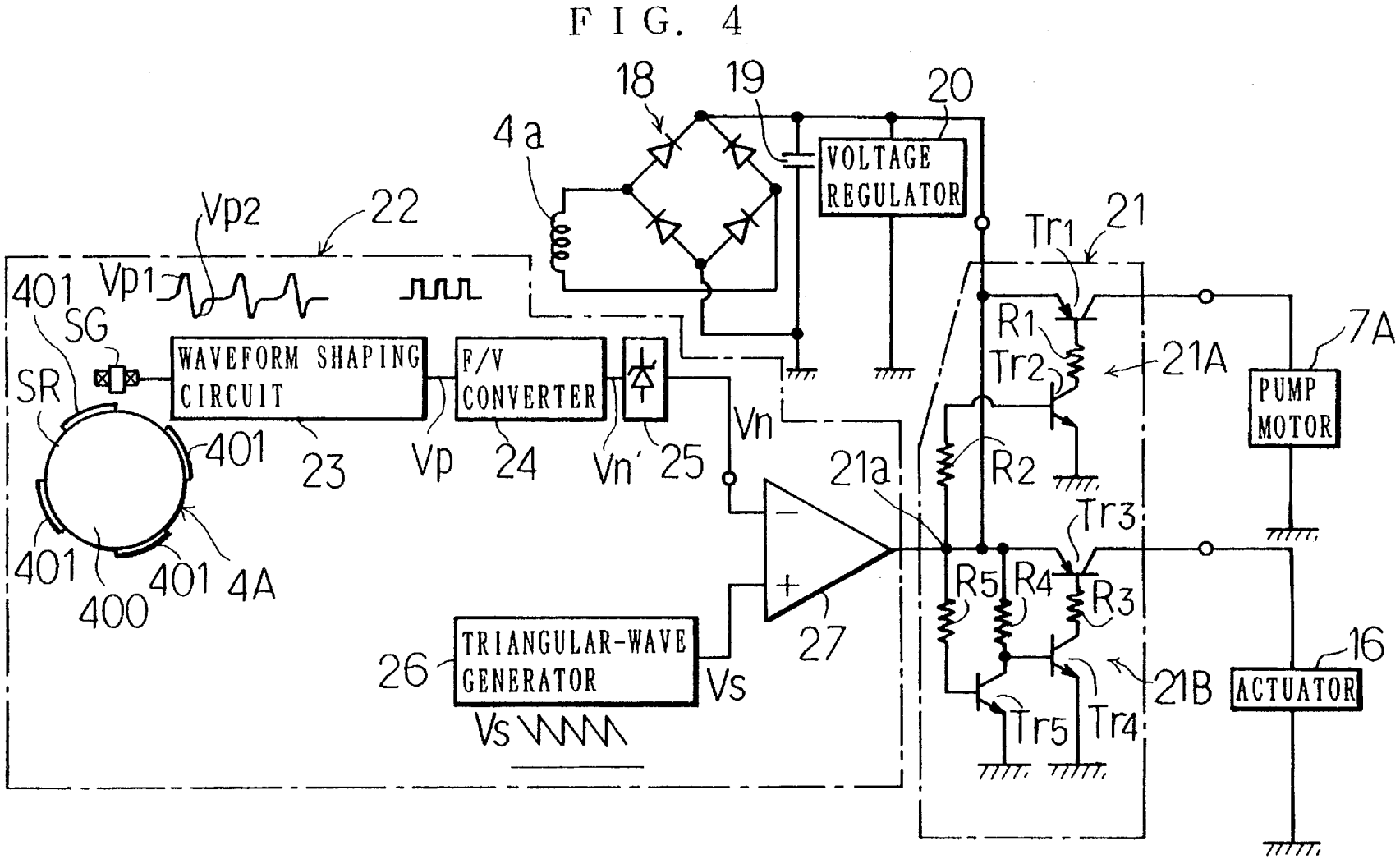
FIG. 4 is a detailed circuit diagram of the driving power feed circuit shown in FIG. 3.

FIG. 4 shows the circuit of the FIG. 3 in detail. As shown in FIG. 4, the pump driving switch 21A of the switch circuit 21 includes transistors Tr1 and Tr2 and resistors R1 and R2 and the actuator driving switch 21B includes transistors Tr3 to Tr5 and resistors R3 to R5. Reference character 21*a* designates a control terminal of the switch circuit 21. When a trigger signal of a high level is fed to the control terminal 21*a*, the transistors Tr2 and Tr5 are turned on and the transistor Tr4 is turned off. At this time, the transistor Tr1 is turned on and the transistor Tr3 is turned off, so that a driving current is fed to the pump motor 7A through the transistor Tr1.

Also, when the trigger signal is removed from the control terminal 21*a* to lower a potential at the control terminal to a low level, the transistors Tr2 and Tr5 are turned off and the transistor Tr3 is turned on, so that a driving current is fed to the actuator 16.

In the illustrated embodiment, a magneto 4 includes a magnet rotor 4A provided with a cup-like yoke (fly wheel) 400, which is provided on an outer periphery thereof with four reluctor (inductor) 401 at equal angular intervals, to thereby provide a signal generating rotor SR. Reference character SG designates a signal generating element arranged in a manner to be opposite to the outer periphery of rotor SR. More particularly, the signal generating element SG includes an iron core having a magnetic section arranged opposite to the outer periphery of the rotor SR, a signal coil wound on the iron core and a magnet magnetically coupled to the iron core. Thus, it will be noted that the signal generating element is a generator of the induction type which is known in the art. The signal generating element SG functions to induce pulse-like signals Vp1 and Vp2 different in polarity from each other across the signal coil when the reluctor 401 starts to be opposite to the magnetic pole section of the signal generating element SG and is released from opposition thereto, respectively. The pulse-like signals thus induced are then fed to a waveform shaping circuit 23, which subjects the pulse-like signal Vp1 of one polarity to waveform shaping to generate four pulse signals Vp per each rotation.

The pulse signals Vp are then fed to a frequency/voltage converter 24, which functions to convert a frequency of each of the pulse signals Vp into a voltage signal Vn'. The voltage signal Vn' thus converted is proportional to a rotation speed of the engine. The output Vn' of the frequency/voltage conversion circuit 24 is fed to an inversion input terminal of a comparator 27 through a voltage limiting circuit 25 comprising a Zener diode or the like.

Also, a triangular-wave signal generator 26 is provided, of which an output is fed to a non-inversion input terminal of the comparator 27, of which an output terminal is connected to the control terminal 21*a* of the switch circuit 21.

In the illustrated embodiment, the signal generating rotor SR, signal generating element SG, waveform shaping circuit 23, frequency/voltage conversion circuit 24, voltage limit circuit 25, comparator 27 and triangle-wave signal generator 26 cooperate with each other to provide the switch control means 22. Electric power for the waveform shaping circuit 23, frequency/voltage conversion circuit 24, voltage limit circuit 25, comparator 27 and triangular-wave signal generator 26 may be led out of an output side of the rectifier. Alternatively, it may be led out of the above-described power circuit utilizing a negative half-cycle output of the ignition power coil.

Figure 5:
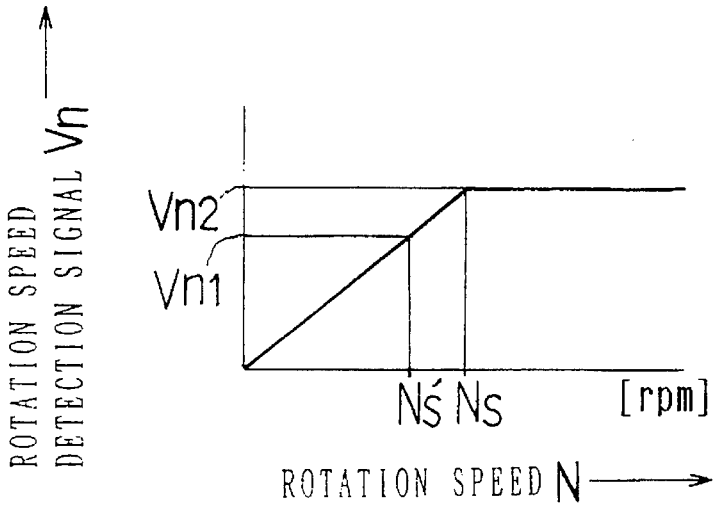
FIG. 5 is a graphical representation showing a relationship between a rotation speed detection signal and a rotation speed of an internal combustion engine in the driving power feed circuit of FIG. 4.

In the circuit shown in FIG. 4, the output voltage Vn' of the frequency/voltage converter 24 is linearly increased with an increase in rotation speed N of the engine. A maximum value of the voltage Vn' is limited by the voltage limit circuit 25. Thus, the inversion input terminal of the comparator 27 is fed with such a rotation speed detection signal Vn as shown in FIG. 5. The signal Vn is linearly increased with an increase in rotation speed N, resulting in reaching a set value Vn1 at a set rotation speed Ns' shown in FIG. 9 and reaching a limit value Vn2 at a set rotation speed Ns. The rotation speed detection signal Vn is kept at a constant value Vn2 in a region exceeding the set rotation speed Ns.

Figure 6A:
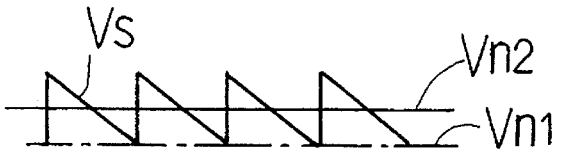
FIGS. 6(A) to 6(D) each are a waveform chart showing a waveform of a signal at each of sections of the driving power feed circuit of FIG. 4.

The triangular-wave signal generator 26, as shown in FIG. 6(A), generates a triangular-wave signal Vs which has a DC bias voltage equal to the above-described set value Vn1 superposed thereon or added thereto. The comparator 27 compares the rotation speed detection signal Vn and triangular-wave signal Vs with each other, so that a potential at the output terminal of the comparator 27 is kept at a high level for a period of time during which the triangular-wave signal Vs exceeds the rotation speed detection signal Vn. The rotation speed detection signal Vn fails to exceed the triangular-wave signal Vs while a rotation speed of the engine is kept low, so that a potential Vt at the output terminal of the comparator 27 is kept at a high level. At this time, the transistors Tr2 and Tr5 are turned on and the transistor Tr4 is turned off, so that the transistor Tr1 (pump driving switch 21A) is turned on and the transistor Tr3 (actuator driving switch 21B) is turned off. Under such conditions, the duty ratio Dp of on-operation of the transistor Tr1 is 1, so that a driving current is fed to only the pump motor 7A.

When a rotation speed of the engine exceeds the set rotation speed Ns' and the rotation speed detection signal Vn exceeds the set value Vn1, the rotation speed detection signal Vn is permitted to exceed the triangular-wave signal Vs, so that a period of time for which the triangular-wave signal Vs exceed the rotation speed detection signal Vn and that for which the rotation speed detection signal Vn exceeds the triangular-wave signal Vs alternately occur. During a period of time for which the triangular-wave signal Vs exceeds the rotation speed detection signal Vn, a potential at the output terminal of the comparator 27 is kept at a high level, so that the transistors Tr1 and Tr3 turned on and turned off in such a manner as described above, respectively. On the contrary, during a period of time for which the rotation speed detection signal Vn exceeds the triangular-wave signal Vs, the potential is kept at a low level, resulting in the transistors Tr2 and Tr5 being turned off and the transistor Tr4 being turned on. At this time, the transistor Tr1 is turned off and the transistor Tr3 (actuator driving switch) is turned on, so that a driving current Ia may be fed through the transistor Tr3 to the actuator 16. Therefore, when a rotation speed of the engine exceeds the set rotation speed Ns', the transistors Tr1 and Tr3 are alternately turned on to permit the driving current to be alternately fed to the pump motor 7A and actuator 16. The duty ratio Da of on-operation of the transistor Tr3 is increased with an increase in rotation speed of the engine and an increase in duty ratio Da is stopped when the rotation speed exceeds the set rotation speed Ns.

Figure 6B:
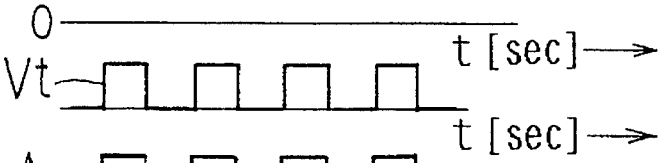
Figure 6C:
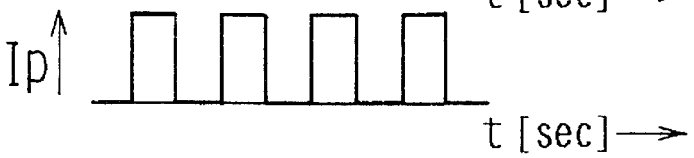
Figure 6D:
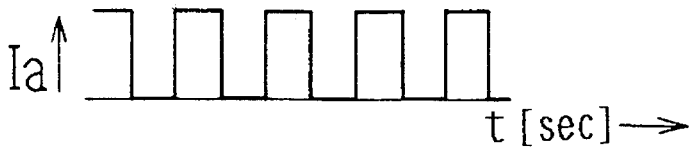

FIG. 6(B) shows a waveform of the potential Vt at the output terminal of the comparator 27 in a state that the rotation speed detection signal Vn reaches the limit value Vn2 and FIGS. 6(C) and 6(D) show driving currents Ip and Ia fed to the pump motor 7A and actuator 16 under the same state, respectively.

A magnitude of each of the duty ratios Dp and Da of on-operation of the actuator driving switch 21B in a high rotation speed region exceeding the set rotation speed Ns may be varied as desired by adjusting the limit valve Vn2 of the rotation speed detection signal Vn.

Thus, the circuit shown in FIG. 4 permits the pump driving switch 21A and actuator driving switch 21B to be alternately turned on at predetermined duty ratios to permit the driving currents to be alternately fed to the pump motor 7A and actuator 16, so that suitable setting of the duty ratios of the switch means permits electric power to be distributed to the pump motor 7A and actuator 16 at a suitable ratio.

Figure 11:
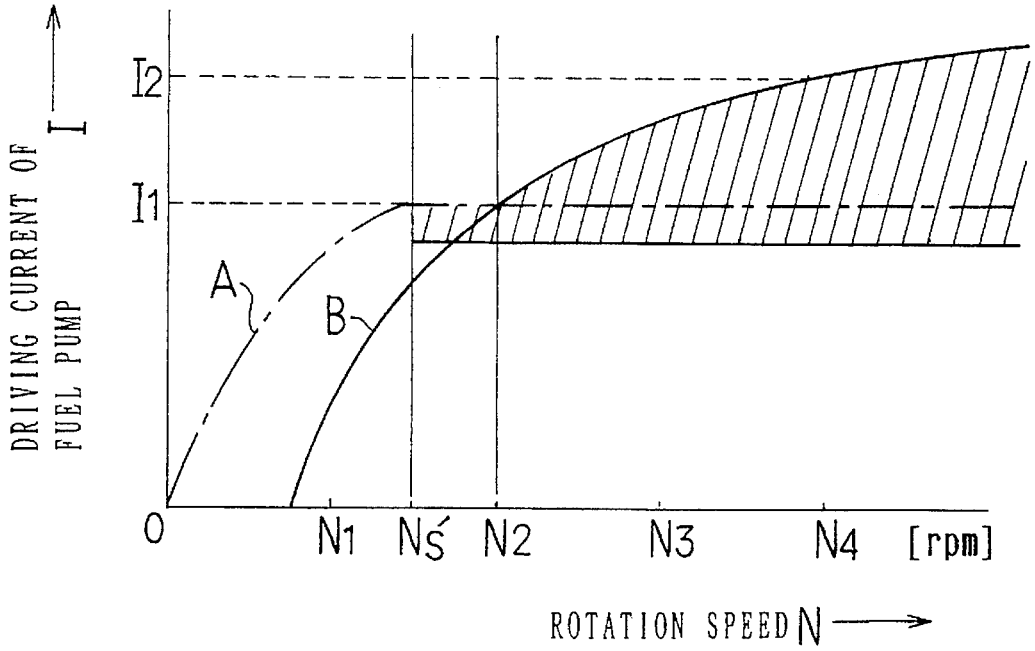
FIG. 11 is a diagrammatic view showing a region in which an actuator can be driven when the driving power feed circuit of FIG. 3 is used, wherein the region is indicated by means of driving-current to engine-speed characteristics of a fuel pump and load-current to engine-speed characteristics obtained when an output voltage of a generating coil for driving an auxiliary equipment generates a rated voltage of a pump motor.

The circuit shown in FIG. 4 permits the pump driving switch 21A and actuator driving switch 21B to be alternately turned on at predetermined duty ratios in a region of the set rotation speed Ns' or more, to thereby permit the driving current to be alternately fed to the pump motor 7A and actuator 16. The current which can be fed to the actuator 16 due to on-off control of the pump driving switch 21A and actuator driving switch 21B is defined in a range indicated by oblique lines in FIG. 11. A curve A in FIG. 11 indicates driving-current to rotation-speed characteristics of the pump motor 7A and a curve B indicates load-current to rotation-speed characteristics obtained when the generating coil 4*a* for driving the auxiliary equipment generates the rated voltage V1 of the pump motor 7A.

Figure 7:
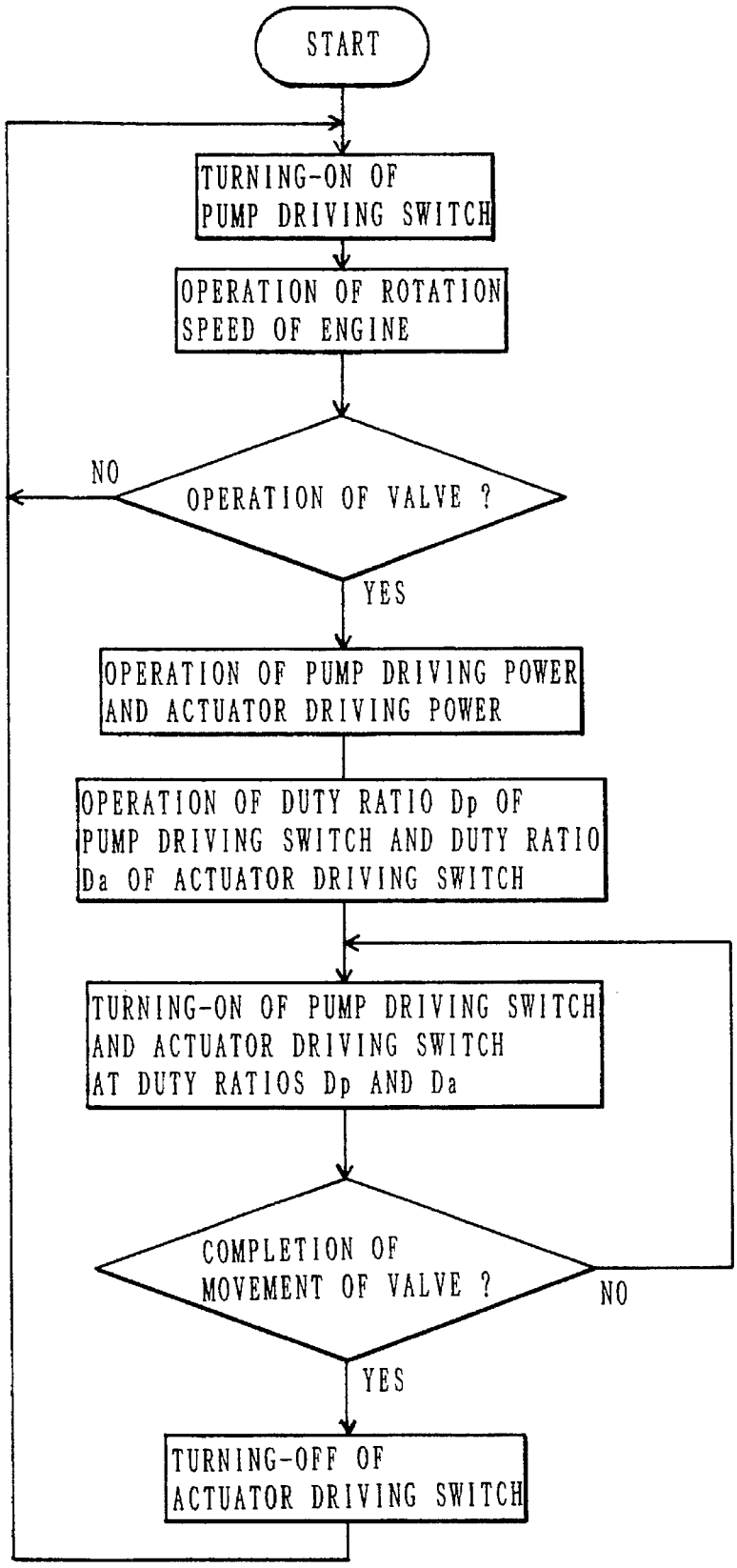
FIG. 7 is a flow chart showing algorithm in the case that a switch control means is realized by a microcomputer.

In each of the embodiments described above, the switch control means 22 is realized by an electronic circuit. Alternatively, the switch control means 22 may be realized by means of a microcomputer. FIG. 7 is a flow chart showing algorithm of the switch control means 22 when it is realized by a microcomputer.

Following the flow chart of FIG. 7, the pump driving switch 21A is first closed, resulting a rotation speed of the engine being operated. A rotation speed of the engine may be obtained on the basis of, for example, a cycle of generation of a signal from a signal generator mounted on the engine. The rotation speed is operated, followed by judging whether or not the rotation speed is sufficient to operate the exhaust characteristic adjusting valve 12. In order to carry out the judgment, a rotation speed of the engine suitable for operation of the exhaust characteristic adjusting valve 12 and the amount of displacement of the valve 12 are previously stored in the form of a map in a ROM. The map is referred to when the rotation speed is operated, so that whether or not it is required to operate the valve 12 at the rotation speed is judged. As a result, when it is judged that it is required to operate the exhaust characteristic adjusting valve 12 at the rotation speed operated, driving power of the pump motor 7A required for obtaining a predetermined fuel pressure at the rotation speed and driving power of the actuator required for displacing the exhaust characteristic adjusting valve 12 in a specified amount are operated.

Then, a duty ratio Dp of the pump driving switch 21A required for obtaining the driving power of the pump motor 7A operated and a duty ratio Da of the actuator driving switch 21B required for obtaining the driving power of the actuator 16 operated are operated, so that the pump driving switch 21A and actuator driving switch 21B are alternatively turned on at the duty ratios Dp and Da, respectively.

Then, an output of a sensor for detecting a position of the exhaust characteristic adjusting valve 12 is monitored, to thereby turn off the actuator driving switch 21B when it is confirmed that movement of the valve 12 is completed, resulting in being returned to the initial state.

In the above-described embodiments, the pump driving switch 21A and actuator driving switch 21B are alternatively turned on. Alternatively, both switches may be operated independently from each other at the respective predetermined duty ratios.

As can be seen from the foregoing, the present invention is so constructed that the generating coil for the auxiliary equipment is arranged in a manner to be common to both pump motor and actuator for driving the valve, to thereby drive the pump motor and actuator. Such construction not only permits an output of the generating coil for driving the auxiliary equipment to be exclusively used for driving the pump motor in a low rotation speed region of the engine in which driving of the exhaust characteristic adjusting valve is not required, to thereby smoothly operate the pump motor without any difficulty, but ensures that driving power is fed to the actuator for driving the valve without sacrificing driving power of the pump motor in a high rotation speed region of the engine in which the generating coil can exhibit an output in a sufficient amount.

Thus, the present invention permits the pump motor and actuator for driving the valve to be driven by means of the generating coil common to both, so that both fuel pump and exhaust characteristic adjusting valve may be smoothly driven without any difficulty by means of a small-sized magneto.

Further, the present invention is constructed in the manner that the pump driving switch for switching a driving current of the pump motor and the actuator driving switch for switching a driving current of the actuator are turned on at duty ratios different from each other, respectively. Such construction permits an output of the generating coil for driving the auxiliary equipment to be appropriately distributed to the pump motor and actuator, resulting in the exhaust characteristic adjusting valve being satisfactory operated without deteriorating operation of the pump motor even in a relatively low rotation speed region of the engine.

While preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A power device for driving, of a plurality of auxiliary equipments arranged on an internal combustion engine, an auxiliary equipment for feeding electric power from a generator driven by the internal combustion engine to a pump motor for driving a fuel pump arranged in a fuel feed system including a pressure regulator and an actuator of the electric type for driving an exhaust characteristic adjusting valve for adjusting characteristics of an exhaust system, comprising:

a generating coil arranged in said generator in a manner to be common to said pump motor and actuator; and a driving power feed circuit for feeding driving power to said pump motor and actuator from said generating coil for driving the auxiliary equipment which acts as a power supply.

2. A power device as defined in claim 1, wherein said driving power feed circuit comprises:

a pump driving switch for switching a driving current of said pump motor;

an actuator driving switch for switching a driving current of said actuator; and a switch control unit for turning on said pump driving switch and actuator driving switch at duty ratios different from each other, respectively.

3. A power device as defined in claim 2, wherein said switch control unit keeps only said pump driving switch turned on until a rotation speed of the internal combustion engine reaches a set value and renders said pump driving switch and actuator driving switch respectively turned on at duty ratios different from each other when said rotation speed exceed said set value.

4. A power device as defined in claim 3, wherein said switch control unit comprises:

a rotation speed detection signal generator for generating a rotation speed detection signal varied in proportion to a rotation speed of the internal combustion engine;

a voltage limit circuit for limiting a value of said rotation speed detection signal to a predetermined limit value or less, said limit value being set to be larger than said set value;

a triangular-wave signal generator for generating a triangular-wave signal to which a DC bias voltage equal to said set value is added; and a comparator for carrying out comparison between said rotation speed detection signal output from said voltage limit circuit and said triangular-wave signal output from said triangular-wave signal generator;

said comparator generating a signal for turning on said actuator driving switch during a period of time for which said rotation speed detection signal is kept larger than said triangular-wave signal and generating a signal for turning on said pump driving switch during the remaining period of time.

5. A power device as defined in claim 2, wherein said switch control unit generates a signal for turning on said pump driving switch and actuator driving switch at said duty ratios by means of a microcomputer.

6. A power device for driving an auxiliary equipment for an internal combustion engine which is provided on an internal combustion engine of the fuel injection type and feeds electric power from a magneto driven by the internal combustion engine to a pump motor for driving a fuel pump for feeding fuel to an injector and an actuator of the electric type for driving an exhaust characteristic adjusting valve, comprising:

a generating coil arranged in said magneto for driving the auxiliary equipment; and a driving power feed circuit for feeding driving power to said pump motor and actuator from said generating coil for driving the auxiliary equipment which acts as a power supply;

said driving power feed circuit including a pump driving switch for switching a driving current of said pump motor, an actuator driving switch for switching a driving current of said actuator, and a switch control unit for turning on said pump driving switch and actuator driving switch at duty ratios different from each other, respectively.

7. A power device as defined in claim 6, wherein said switch control unit keeps only said pump driving switch turned on until a rotation speed of the internal combustion engine reaches a set value and renders said pump driving switch and actuator driving switch respectively turned on at duty ratios different from each other when said rotation speed exceed said set value.

8. A power device as defined in claim 7, wherein said switch control unit comprises:

a rotation speed detection signal generator for generating a rotation speed detection signal varied in proportion to a rotation speed of the internal combustion engine;

a voltage limit circuit for limiting a value of said rotation speed detection signal to a predetermined limit value or less, said limit value being set to be larger than said set value;

a triangular-wave signal generator for generating a triangular-wave signal to which a DC bias voltage equal to said set value is added; and a comparator for carrying out comparison between said rotation speed detection signal output from said voltage limit circuit and said triangular-wave signal output from said triangular-wave signal generator;

said comparator generating a signal for turning on said actuator driving switch during a period of time for which said rotation speed detection signal is kept larger than said triangular-wave signal and generating a signal for turning on said pump driving switch during the remaining period of time.

9. A power device as defined in claim 6, wherein said switch control unit generates a signal for turning on said pump driving switch and actuator driving switch at said duty ratios by means of a microcomputer.

* * * * *

UNITED STATES PATENT AND TRADEMARK OFFICE

CERTIFICATE OF CORRECTION

PATENT NO. : 5,502,963

DATED : April 2, 1996

INVENTOR(S) : Yutaka Inaba

It is certified that error appears in the above-indentified patent and that said Letters Patent is hereby corrected as shown below:

Title page, item [57] Col. 2,

In the Abstract, line 3, after "a" (second occurrence), insert --generating coil exclusively used for an exhaust characteristic--.

Signed and Sealed this

Twentieth Day of August, 1996

*Attest:*

*Attesting Officer*

BRUCE LEHMAN

*Commissioner of Patents and Trademarks*